US006617303B1

(12) United States Patent
Smith et al.

(10) Patent No.: US 6,617,303 B1
(45) Date of Patent: Sep. 9, 2003

(54) SURFACTANT COMPOSITIONS CONTAINING ALKOXYLATED AMINES

(75) Inventors: George A. Smith, Austin, TX (US); Raeda M. Smadi, Round Rock, TX (US)

(73) Assignee: Huntsman Petrochemical Corporation, Austin, TX (US)

( * ) Notice: Subject to any disclaimer, the term of this patent is extended or adjusted under 35 U.S.C. 154(b) by 0 days.

(21) Appl. No.: 09/479,436

(22) Filed: Jan. 7, 2000

Related U.S. Application Data

(60) Provisional application No. 60/139,441, filed on Jun. 15, 1999, and provisional application No. 60/115,408, filed on Jan. 11, 1999.

(51) Int. Cl.[7] ..... C11D 1/12; C11D 1/75; C11D 3/26

(52) U.S. Cl. ..... 510/499; 510/336; 510/341; 510/342; 510/350; 510/351; 510/356; 510/357; 510/495; 510/506; 510/536; 510/537

(58) Field of Search ..... 510/336, 341, 510/342, 350, 351, 356, 357, 495, 499, 506, 536, 537

(56) References Cited

U.S. PATENT DOCUMENTS

| | | | | |
|---|---|---|---|---|
| 3,349,141 | A | 10/1967 | Sweeney | 260/668 |
| 3,776,962 | A | 12/1973 | Alul et al. | 260/624 C |
| 3,951,960 | A | 4/1976 | Heath et al. | 260/240 |
| 3,980,713 | A | 9/1976 | Matsunaga et al. | 260/612 |
| 3,985,687 | A | 10/1976 | Inamorato et al. | 252/551 |
| 3,993,659 | A | 11/1976 | Meyer | 260/307 |
| 4,028,283 | A | 6/1977 | Murata et al. | 252/551 |
| 4,075,130 | A | 2/1978 | Naylor et al. | |
| 4,244,840 | A | 1/1981 | Straw | 252/540 |
| 4,301,317 | A | 11/1981 | Young | 585/455 |
| 4,396,520 | A | 8/1983 | Payne et al. | 252/89.1 |
| 4,515,704 | A | 5/1985 | Akred et al. | |
| 4,537,705 | A | 8/1985 | Mahoney et al. | |
| 4,618,446 | A | 10/1986 | Haslop et al. | 252/135 |
| 4,645,623 | A | 2/1987 | Dolan et al. | 252/558 |
| 4,659,497 | A | 4/1987 | Akred et al. | |
| 4,663,069 | A | 5/1987 | Llenado | 252/117 |
| 4,668,423 | A | 5/1987 | Drozd et al. | 252/174 |
| 4,687,593 | A | 8/1987 | Dolan et al. | 252/182 |
| 4,692,271 | A | 9/1987 | Messenger et al. | 252/354 |
| 4,746,461 | A | 5/1988 | Zielske | 260/370 |
| 4,753,754 | A | 6/1988 | Messenger et al. | 252/354 |
| 4,760,200 | A | 7/1988 | Keen et al. | 568/867 |
| 4,793,943 | A | 12/1988 | Haslop et al. | |
| 4,871,467 | A | 10/1989 | Akred et al. | |
| 4,973,780 | A | 11/1990 | Johnson et al. | 585/467 |
| 5,034,564 | A | 7/1991 | Kocal | 585/467 |
| 5,039,451 | A | 8/1991 | Phillips et al. | |
| 5,086,193 | A | 2/1992 | Sy | 585/446 |
| 5,146,026 | A | 9/1992 | Berna Tejero et al. | 585/467 |
| 5,147,576 | A | 9/1992 | Montague et al. | 252/174 |
| 5,152,933 | A | 10/1992 | Holland | 252/559 |
| 5,167,872 | A | 12/1992 | Pancheri et al. | 252/544 |
| 5,196,574 | A | 3/1993 | Kocal | 562/94 |
| 5,219,495 | A | 6/1993 | Hsu | 252/599 |
| 5,242,615 | A | 9/1993 | Urfer et al. | 252/174.17 |
| 5,256,828 | A | 10/1993 | Cuscurida et al. | 568/620 |

(List continued on next page.)

FOREIGN PATENT DOCUMENTS

| | | |
|---|---|---|
| EP | 0 006 348 A1 | 9/1980 |
| EP | 0038101 | 10/1981 |
| EP | 0113978 A1 | 12/1983 |
| EP | 0 151 678 A1 | 8/1985 |
| EP | 0151884 | 8/1985 |
| EP | 0160144 | 11/1985 |
| EP | 0160145 | 11/1985 |
| EP | 0 211 493 A2 | 2/1987 |
| EP | 0 265 203 A1 | 4/1988 |
| EP | 0353813 | 2/1990 |
| EP | 0 391 392 A2 | 4/1990 |
| EP | 0 484 095 A2 | 5/1992 |
| EP | WO 92/09678 | 6/1992 |
| EP | 0633307 A1 | 7/1994 |
| EP | WO 96/30484 | 10/1996 |
| EP | 0 786 516 A2 | 7/1997 |
| GB | 2 174 101 A | 10/1986 |
| WO | WO 93/00317 | 1/1993 |
| WO | WO 95/31528 | 11/1995 |
| WO | WO 95/33035 | 12/1995 |
| WO | WO 97/04064 | 2/1997 |
| WO | WO 97/16514 | 5/1997 |
| WO | WO 97/39089 | 10/1997 |
| WO | WO 97/39095 | 10/1997 |
| WO | WO 97/47717 | 12/1997 |
| WO | WO 98/00509 | 1/1998 |
| WO | WO 98/46721 | 10/1998 |
| WO | WO 99/19431 | 4/1999 |
| WO | WO 99/28423 | 6/1999 |

OTHER PUBLICATIONS

Brown et al., "Poly(ethylene oxide)–sodium dodecyl sulfate interactions studied using static and dynamic light scattering," *Macromolecules,* 25:7192–7198, 1992.

Cohen et al., "Influence of 2–phenyl alkane and tetralin content on solubility and viscosity of linear alkylbenzene sulfonate," *JAOCS,* 72(1):115–122, 1995.

Contractor et al., "Interaction of PEO–PS–PEO block copolymers with ionic surfactants in aqueous solution," *Pure Appl. Chem.,* A34(12):2497–2507, 1997.

(List continued on next page.)

*Primary Examiner*—Gregory Delcotto
(74) *Attorney, Agent, or Firm*—O'Keefe, Egan & Peterman, LLP

(57) ABSTRACT

Anionic surfactant compositions containing alkoxylated amines and having enhanced detergent performance. The compositions may be formulated with anionic surfactants such as alkylbenzene sulfonates having cations that may be exchanged with, for example, ethoxylated amine and/or ethoxylated ether amine to form a salt.

18 Claims, No Drawings

U.S. PATENT DOCUMENTS

| | | | | | |
|---|---|---|---|---|---|
| 5,273,644 | A | | 12/1993 | Wegerer | 208/66 |
| 5,298,193 | A | | 3/1994 | Klinger et al. | 252/355 |
| 5,344,997 | A | | 9/1994 | Kocal | 568/628 |
| 5,415,814 | A | | 5/1995 | Ofosu-Asante et al. | 252/558 |
| 5,446,223 | A | | 8/1995 | Smith, Jr. et al. | 585/313 |
| 5,447,651 | A | | 9/1995 | Karpusiewicz et al. | 252/174 |
| 5,550,115 | A | | 8/1996 | Garst et al. | 514/25 |
| 5,580,848 | A | | 12/1996 | Drapier | 510/417 |
| 5,616,811 | A | | 4/1997 | Vipond et al. | 564/505 |
| 5,631,205 | A | | 5/1997 | Killick et al. | 504/16 |
| 5,703,028 | A | | 12/1997 | Erilli et al. | 510/236 |
| 5,716,925 | A | | 2/1998 | Mondin et al. | 510/365 |
| 5,719,118 | A | | 2/1998 | Crutcher et al. | 510/499 |
| 5,780,417 | A | | 7/1998 | Gorlin | 510/426 |
| 5,807,810 | A | | 9/1998 | Blezard et al. | |
| 5,847,254 | A | | 12/1998 | Knifton et al. | 585/463 |
| 5,952,285 | A | | 9/1999 | Hawkins | |
| 6,080,713 | A | * | 6/2000 | Crutcher | 510/413 |
| 6,083,897 | A | | 7/2000 | Lewis et al. | |
| 6,090,762 | A | | 7/2000 | Clapperton et al. | |
| 6,133,217 | A | | 10/2000 | Lewis et al. | |
| 6,177,396 | B1 | | 1/2001 | Clapperton et al. | |

OTHER PUBLICATIONS

Cox and Smith, "Effect of LAB composition of LAS performance," *INFORM,* 8(1):19–24, 1997.

de Ameida et al., "Linear alkylbenzene," *JAOCS,* 71(7):675–693, 1994.

Drazd, "An introduction to light duty (dishwashing) liquids Part I. Raw materials," *Chemical Times & Trends,* pp. 29–57, 1984.

Drazd and Gorman, "Formulating characteristics of high and low 2–phenyl linear alkylbenzene sulfonates in liquid detergents," *JAOCS,* 65(3):398–404, 1988.

"Formulating Characteristics of High and Low 2–Phenyl Linear Alkylbenzene Sulfonates in Liquid Detergents," Presented at 77th Annual AOCS Meeting, May 17, 1986, Honolulu, HI by Stepan Company, Northfield, IL.

Friberg and Chiu, "Hydrotropes," *J. Dispersion Sci. Technol.,* 9(5&6):443–457, 1988–89.

Goddard, "Polymer–surfactant interation Part I. Uncharged water–solublel polymers and charged surfactants," *Colloids and Surfaces,* 19:255–300, 1986.

Gorlin et al., "Liquid automatic dishwasher detergents," *In: Liquid Detergents,* Kuo–Yann Lai (Ed.), Marcel Dekker, Inc., NY, Chapter 9, pp. 325–380, 1997.

Huntsman brochure entitled: "Surfactants: A complete line of specialty surfactants and intermediates," 1996.

Huntsman brochure entitled: "Surfactants: Detergents," 1996.

Huntsman brochure entitled: "Surfactants: Linear Alkylbenzenes Alkylate 215, 225 & 229," 1996.

Huntsman brochure entitled: "Surfactants: Product flow chart," 1998.

Huntsman Technical Bulletin, ALKYLATE 215, 1997.

Huntsman Technical Bulletin, ALKYLATE 225, 1997.

Huntsman Technical Bulletin, ALKYLATE 229, 1997.

Huntsman Surfactant Application Notes, vol. 2, POGOL™Polyethylene Glycols, 1997.

Huntsman Technical Bulletin, Surfonic®POA–L42, 1997.

Huntsman Technical Bulletin, Surfonic®POA–L44, 1997.

Huntsman Technical Bulletin, Surfonic®POA–L61, 1997.

Huntsman Technical Bulletin, Surfonic®POA–L62, 1997.

Huntsman Technical Bulletin, Surfonic®POA–L62LF, 1997.

Huntsman Technical Bulletin, Surfonic®POA–L64, 1997.

Huntsman Technical Bulletin, Surfonic®POA–L81, 1997.

Huntsman Technical Bulletin, Surfonic®POA–L101, 1997.

Huntsman Technical Bulletin, Surfonic®POA–25R2, 1997.

Huntsman Technical Bulletin, POGOL™ 200 Polyethylene Glycol, 1997.

Huntsman Technical Bulletin, POGOL™ 300 Polyethylene Glycol, 1997.

Huntsman Technical Bulletin, POGOL™ 400 Polyethylene Glycol, 1997.

Huntsman Technical Bulletin, POGOL™ 500 Polyethylene Glycol, 1997.

Huntsman Technical Bulletin, POGOL™ 600 Polyethylene Glycol, 1997.

Huntsman Technical Bulletin, POGOL™ 900 Polyethylene Glycol, 1997.

Huntsman Technical Bulletin, POGOL™ 1000 Polyethylene Glycol, 1997.

Huntsman Technical Bulletin, POGOL™ 1005 Polyethylene Glycol, 1997.

Huntsman Technical Bulletin, POGOL™ 1450 Polyethylene Glycol, 1997.

Xia et al., "Complex formation betwen poly(oxyethylene) and sodium dodecyl sulfate micelles: light scattering, electrophoresis, and dialysis equilibrium studies," *J. Phys. Chem.,* 96:6805–6811, 1992.

Jakobi and Löhr, *In: Detergents and Textile Washing: Principles and Practice,* Henkel KGaA, Düsseldorf, pp. 41–107, 1987.

Lai et al., "Light–duty liquid detergents," *In: Liquid Detergents,* Kuo–Yann Lai (Ed.), Marcel Dekker, Inc., NY, Chapter 7, pp. 207–260, 1997.

Loughney and Quencer, "Surfactants for high–performance cleaning," *Soap/Cosmetics/Chemical Specialities,* pp. 24–30, Jan., 1992.

Maltesh and Somasundaran, "Effect of binding of cations to polyethylene glycol on its interactions with sodium dodecyl sulfate," *Langmuir,* 8:1926–1930, 1992.

Matheson and Matson, "Effect of carbon chain and phenyl isomer distribution on use properties of linear alkylbenzene sulfonate: a comparison of 'high' and 'low'2–phenyl LAS homologs," *JAOCS,* 60(9):1693–1698, 1983.

Milwidsky, "Variations of Neutralizing Cations and Their Effects on Las Properties," *HAPPI,* pp. 44, 48, Jan. 1984.

Moreno et al., "Influence of unsulfonated material and its sulfone content on the physical properties of linear alklybenzene sulfonates," *JAOCS,* 65(6):1000–1006, 1988.

Moreno et al., "Influence of structure and counterions on physicochemical properteis of linear alkylbenzene sulfonates," *JAOCS,* 67(8):547–552, 1990.

Nace (Ed.), *In: Nonionic Surfactants: Polyoxyalkylene Block Copolymers,* vol. 60, Marcel Dekker, Inc., NY, 1996.

*Pluronic & Tetronic Block Copolymer Surfactants,* BASF Catalogue, pp. 1–29, 1989.

Sachdev and Krishnan, "Heavy–duty liquid detergents," *In: Liquid Detergents,* Kuo–Yann Lai (Ed.), Marcel Dekker, Inc., NY, Chapter 8, pp. 261–324, 1997.

Smith, "Impact of composition on the performance of sodium linear alkylbenzenesulfonate (NaLAS)," *JAOCS,* 74(7):837–845, 1997.

Sweeney and Olson, "Performance of straigh–chain alkylbenzene sulfonates (LAS) in heavy–duty detergents," 41:815–822, 1964.

Tjepkema et al., "Relationship between the structure of phenyldodecane isomers and their performance as detergent base materials," *Fifth World Petroleum Congress,* Section IV–Paper 21, pp. 237–243, 1959.
van Os et al., "Alkylarenesulphonates: The effect of chemical structure on physico–chemical properties," *Tenside Surf. Det.,* 29(3):175–189, 1992.
"Surfactants Literature," 1999.
Akzo Nobel catalog entitled "Surface Chemistry: Industrial surfactants general catalog, nitrogen derivatives." (1996).
Friberg, "Microemulsions and micellar solutions," *Microemulsions Theory and Practice,* pp. 133–134. (1997).
Huntsman brochure entitled "Surfactants: SURFONIC® Alcohol Ethoxylates," 1996.
Huntsman brochure entitled "Surfactants: SURFONIC® Alkylphenol Ethoxylates," 1996.
Huntsman Technical Bulletin, SURFONIC® PEA–25, 1999.
Huntsman Technical Bulletin, SURFONIC® T–15, 1999.
Kirk–Othmer ed. "Microemulsions," *Ency. of Chem. Tech.,* Supplement Volume, pp. 299–303. (1997).
Kirk–Othmer ed. "Surfactants," *Ency. of Chem. Tech.,* 23:478–491 (1997).
Pillai and Shah, ed., *Dynamic Properties of Interfaces and Association Structures,* pp. 55, 127, 142, 156, 178, 179, 183, 194, 196, 233, 264. (1996).
Prince, "Schulman's microemulsions," *Microemulsions Theory and Practice,* p. 1–4, 8–9, 17–18, 113–114, 116. (1997).
Rosano and Clausse, eds., *Microemulsion Systems,* p. 280. (1998).
Stepan brochure entitled "Your complete surfactant source." (1998).
Tomah Products, Inc. brochure entitled "The Chemistry of Tomah Products, Inc." (1999).
Witco brochure entitled "Fabric Care: Surfactant & Specialty Products," 1996.
Blease et al., "In: Defoaming Theory and Industrial Applications", P. R. Garrett (Ed.), Ch. 8, pp. 299–323, 1993.
Robert A. Farington and Alberty Daniels, "Liquid Crystals", *Physical Chemistry Fifth Edition,* Ch. 19, pp. 616–617, (1997).
John H. Clint, "Surfactant Aggregation," *Blackie & Son, Ltd.,* pp. 160–170, 1992.
Sherril D. Christian and John F. Scamehorn, "Solubilization in Surfactant Aggregates," pp. 118–120, 1995.
N. Irving Sax and Richard J. Lewis, Sr., "Hawley's Condensed Chemical Dictionary Eleventh Edition," *Van Nostrand Reinhold,* p. 705, (1996).
U.S. Provisional Patent Application Serial Number 60/141,951 Entitled "Concentrated Surfactant Blends," filed Jun. 30, 1999. (HUNS:085PZ1).
U.S. Patent Application Serial No. 09/141,660 entitled "Solubilization of Low 2–Phenyl Alkylbenzene Sulfonates," by Ronald G. Lewis and David C. Lewis, filed on Aug. 28, 1998 (HUNT:071).
U.S. Patent Application Serial No. 09/143,177 entitled "Solubilization of Low 2–Phenyl Alkylbenzene Sulfonates" by Ronald G. Lewis and David C. Lewis, filed Aug. 28, 1998 (HNTC:059 a/k/a HUNT:070).
U.S. Patent Application Serial No. 09/303,096 filed Apr. 29, 1999.
U.S. Patent Application Serial Number 09/543,529 (HUNT:077) filed Apr. 6, 2000.
U.S. Patent Application Serial Number 09/603,168 (HUNT:085) filed Jun. 26, 2000.
International Search Report PCT/US 00/00393 dated Jun. 6, 2000.

* cited by examiner

SURFACTANT COMPOSITIONS CONTAINING ALKOXYLATED AMINES

The present application claims priority on provisional U.S. patent application Ser. No. 60/139,441 filed Jun. 15, 1999, and also claims priority on provisional U.S. patent application Ser. No. 60/115,408 filed Jan. 11, 1999. The entire text and all contents of each of the above-referenced disclosures is specifically incorporated by reference herein without disclaimer.

BACKGROUND OF THE INVENTION

1. Field of the Invention

The present invention relates generally to anionic surfactant compositions and, more particularly, to anionic surfactant compositions containing alkoxylated amine surfactants, such as ethoxylated amines and/or ethoxylated ether amines, and having enhanced detergent performance.

2. Description of Related Art

Multiple surfactants in formulated laundry detergents are often employed. For example, anionic surfactants have been found to give good performance on polar types of soils and help to prevent soil redeposition. Nonionic surfactants have been found to give good detergency on nonpolar soils and have better hard water tolerance.

Typical anionic surfactants used in laundry include, but are not limited to, linear alkyl benzene sulfonates, alkyl sulfates, ether sulfates, secondary alkyl sulfates, α-olefin sulfonate, phosphate esters, sulfosuccinates, isethionates, carboxylates, etc. Most of these surfactants are typically sold in the form of a sodium salt.

One common type of anionic surfactant, linear alkylbenzene sulfonate ("LAS"), is widely used in commercial cleanser products due to its effectiveness as a detergent, ease of biodegradation, and relative low cost. Typically, linear alkylbenzene sulfonates are produced via sulfonation of linear alkylbenzene intermediates.

Linear alkylbenzene is typically manufactured on an industrial scale using one of three commercial processes which differ from one another primarily by virtue of the catalyst system employed. In this regard, one process employs an aluminum trichloride catalyst, another process uses a hydrogen fluoride catalyst while the third process uses solid alkylation catalyst. The three processes result in linear alkylbenzene products with different phenyl isomer distributions. For example, a typical phenyl isomer distribution for products of the aluminum trichloride process is about 30% 2-phenyl isomer and about 22% 3-phenyl isomer. In contrast, a typical phenyl isomer distribution for products of the hydrogen fluoride process is about 20% 2-phenyl isomer and about 20% 3-phenyl isomer, although reported values may differ. The product of the aluminum trichloride process, which is relatively high in 2-phenyl isomer content, is often referred to as "high 2-phenyl" linear alkylbenzene, whereas the product of the hydrogen fluoride process, which is relatively low in 2-phenyl isomer content, is often referred to as "low 2-phenyl" linear alkylbenzene.

The sulfonates of linear alkylbenzenes are known to exhibit different physical properties depending upon the position of the aromatic group on the alkyl chain. Therefore, high 2-phenyl linear alkylbenzene sulfonates have physical properties that differ from low 2-phenyl linear alkylbenzene sulfonates. For example, high 2-phenyl linear alkylbenzene sulfonates typically have a higher solubility in aqueous media than do low 2-phenyl linear alkylbenzene sulfonates.

Furthermore, an aqueous solution comprising a high 2-phenyl linear alkylbenzene sulfonate may exhibit a higher viscosity than an aqueous solution comprising a low 2-phenyl linear alkylbenzene sulfonate. In cases where maximum solubility of linear alkylbenzene sulfonate in an aqueous detergent formulation is of concern, a product containing a relatively high percentage of compounds in which the aromatic substituent is in the 2 or 3 position and a correspondingly smaller percentage of isomers in which the aromatic substituent is positioned centrally with respect to the alkyl chain may be advantageous.

Hydrotropes, such as sodium xylene sulfonate, may be added to improve solubility of low 2-phenyl linear alkylbenzene sulfonates. As used herein, the term "hydrotrope" is defined to be a compound that has the property of increasing the aqueous solubility of various slightly soluble organic chemicals.

SUMMARY OF THE INVENTION

Disclosed herein are improved surfactant compositions. Surprisingly, detergent performance of the disclosed surfactant compositions is enhanced by utilizing ethoxylated amine surfactants to supply the cation of a salt of an anionic surfactant. The disclosed surfactant compositions may be advantageously employed for a number of uses including the formulation of any surfactant or detergent composition in which one or more anionic surfactant/s are present as a surfactant component. Examples include, but are not limited to, in the formulation of heavy duty laundry detergents, herbicide emulsifiers, hard surface cleaners, bathroom cleaners, all purpose cleaners, car wash detergents, janitorial cleaners and light duty liquid detergents.

In one respect, disclosed is a surfactant composition, including at least one anionic surfactant, and at least one ethoxylated surfactant, the ethoxylated surfactant being present in an amount greater than 15% of the surfactant actives by weight, and being at least one of ethoxylated amine, ethoxylated ether amine, or a mixture thereof. In this embodiment, other components are optional, and may or may not be present. For example, the surfactant composition may further include water. The composition may also include a neutralizing compound, the neutralizing compound being at least one of alkanolamine, alkylamine, ammonium hydroxide, NaOH, KOH, or a mixture thereof. In this regard, an alkanolamine may include at least one of monoethanolamine ("MEA"), diethanol amine ("DEA"), triethanol amine ("TEA"), or a mixture thereof. An anionic surfactant may include at least one of alkyl benzene sulfonate, alkyl sulfate, ether sulfate, secondary alkyl sulfate, α-olefin sulfonate, phosphate ester, sulfosuccinate, isethionate, carboxylate, or a mixture thereof. An ethoxylated amine surfactant may include at least one of ethoxylated primary, secondary or tertiary amine, or a mixture thereof. An ethoxylated tertiary amine surfactant may have the formula:

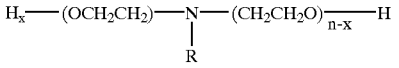

wherein: R=straight or branched alkyl group having from about 8 to about 22 carbon atoms;

n=moles of ethoxylation and is from about 2 to about 50; and x=from about 1 to about 49.

Alternatively, in the preceding embodiment, n may be from about 2 to about 30 and x may be from about 1 to about 29.

An ethoxylated amine surfactant may be a tallow-amine-ethoxylate having the formula:

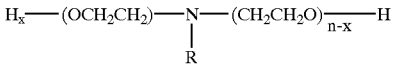

wherein: R=straight or branched alkyl group having from about 16 to about 18 carbon atoms;

n=moles of ethoxylation and is from about 5 to about 20; and x=from about 4 to about 19.

An ethoxylated ether amine surfactant may have the formula:

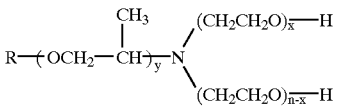

wherein: R=straight or branched alkyl group having from about 8 to about 18 carbon atoms;

n=moles of ethoxylation and is from about 2 to about 30; and x=from about 1 to about 29; and y=1 to 30.

Alternatively, in the preceding embodiment, n may be from about 2 to about 50 and x may be from about 1 to about 49.

In another respect, disclosed is a surfactant composition, including: from about 8% to about 35% of the surfactant actives by weight of an anionic surfactant, wherein the anionic surfactant includes at least one of alkyl benzene sulfonate, alkyl sulfate, ether sulfate, secondary alkyl sulfate, α-olefin sulfonates, phosphate esters, sulfosuccinates, isethionates, carboxylates, or a mixture thereof; from about 8% to about 35% of the surfactant actives by weight of an ethoxylated surfactant, wherein the ethoxylated surfactant is at least one of ethoxylated amine, ethoxylated ether amine, or a mixture thereof; from about 15% to about 55% of the surfactant actives by weight of a nonionic surfactant, wherein the nonionic surfactant includes at least one of nonylphenol ethoxylate, alcohol ethoxylate, ethylene oxide/propylene oxide block copolymer, or a mixture thereof; from about 10% to about 90% water by weight of total weight of the composition; and from about 0% to about 9% neutralizing compound by weight of total weight of the composition, wherein the neutralizing compound includes at least one of alkanolamine, alkylamine, ammonium hydroxide, sodium hydroxide, potassium hydroxide, or mixture thereof; and wherein the total active surfactant concentration is from about 10% to about 90% by weight of total weight of the composition. The alkanolamine may include at least one of monoethanolamine, DEA, TEA, or a mixture thereof. The anionic surfactant may include at least one of alkyl benzene sulfonate, alkyl sulfate, ether sulfate, secondary alkyl sulfate, α-olefin sulfonates, phosphate esters, sulfosuccinates, isethionates, carboxylates, or a mixture thereof. The ethoxylated amine surfactant may include at least one of ethoxylated primary, secondary or tertiary amine, or a mixture thereof. The ethoxylated amine surfactant may be a tertiary amine having the formula:

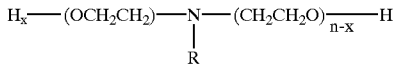

wherein: R=straight or branched alkyl group having from about 8 to about 22 carbon atoms;

n=moles of ethoxylation and is from about 2 to about 50; and x=from about 1 to about 49.

Alternatively, in the preceding embodiment, n may be from about 2 to about 30 and x may be from about 1 to about 29.

The ethoxylated amine surfactant may be a tallow-amine-ethoxylate having the formula:

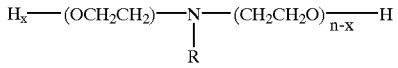

wherein: R=straight or branched alkyl group having from about 16 to about 18 carbon atoms;

n=moles of ethoxylation and is from about 5 to about 20; and x=from about 4 to about 19.

The nonionic surfactant may include at least one of nonylphenol ethoxylate, alcohol ethoxylate or EO—PO block copolymer, or a mixture thereof.

In another respect, disclosed is a surfactant composition, including anionic surfactant; and greater than 15% of surfactant actives by weight of an alkoxylated tertiary amine surfactant. The surfactant composition may include from 15% to about 35% of surfactant actives by weight alkoxylated tertiary amine surfactant, alternatively from about 17% to about 35% of the surfactant actives by weight alkoxylated tertiary amine surfactant alternatively from about 20% to about 35% of surfactant actives by weight alkoxylated tertiary amine surfactant. The surfactant composition may alternatively include greater than about 17% of surfactant actives by weight alkoxylated tertiary amine surfactant, alternatively from about 20% to about 35% of surfactant actives by weight alkoxylated tertiary amine surfactant. Further alternatively the composition may include individual respective ranges of weight percentage values greater than each respective integer defined between 15 and 35%, or alternatively individual respective ranges of weight percentage values between 35% and each respective integer defined between 15% and 34%.

In another respect, disclosed is a surfactant composition, including at least one anionic surfactant; and greater than 15% of the surfactant actives by weight alkoxylated tertiary amine surfactant. In this embodiment, other components are optional, and may or may not be present. The composition may include from 15% to about 50% of the surfactant actives by weight alkoxylated tertiary amine surfactant.

In another respect, disclosed is a surfactant composition, including at least one anionic surfactant, at least one alkoxylated surfactant, at least one nonionic surfactant, propylene glycol, at least one neutralizing compound, and substantially no water, and wherein the components are present in amounts such that the surfactant solution exists as a substantially homogenous liquid phase at a temperature of about 40° F. Thus, using the disclosed method a surfactant composition that exists as a substantially homogenous liquid solution (or as a solution of substantially uniformly dispersed components) at about 40° F. may be formulated from effective amounts of: anionic surfactant; alkoxylated surfactant; optional nonionic surfactant; polyethylene glycol; optional neutralizing compound, and substantially no water. Water or aqueous solvent may be optionally added, however.

DETAILED DESCRIPTION OF ILLUSTRATIVE EMBODIMENTS

As used herein, the indefinite articles "a" and "an" connote "one or more." When individual active surfactant concentrations are expressed herein for a surfactant composition as a percentage of the surfactant actives by weight, it refers to the weight of a given surfactant actives expressed as a percentage of the total weight of all surfactants actives present in the given composition, excluding any non-surfactant components. For those compositions made up of 100% active surfactant materials, the weight percentage of a given component expressed as a percentage of surfactant actives would be the same as the weight percentage expressed as a percentage of the total weight of the composition.

In the following description, Tables 1–12 are referred to with regard to specific commercial and exemplary components which may be employed in various combinations in the formulation of the disclosed surfactant compositions. With benefit of this disclosure it will be understood by those of skill in the art that any of the specific compounds, and/or combinations thereof, disclosed in these tables may be employed to the extent they are suitable for use in any of the embodiments disclosed herein, whether otherwise specifically referred to or not.

In the formulation of the disclosed surfactant compositions, ethoxylated amine surfactants may be combined with salts or acids of anionic surfactants to form salts between the ethoxylated amine surfactants and the anionic surfactants. Such salts may be formed, for example, via exchange of amine and sodium cations.

A range of alkoxylated amine surfactants may be used to form the salt. Suitable alkoxylated amines include any ethoxylated amines capable of forming a water soluble salt with an anionic surfactant. Examples include primary, secondary and tertiary alkoxylated amines, ethoxylate ether amines, as well as mixtures thereof.

In one embodiment, suitable tertiary alkoxylated amine surfactants consist of a hydrocarbon tail attached to a nitrogen atom. The nitrogen atom has been alkoxylated to give tertiary amine. In one example, the tertiary amine is capable of abstracting a proton from a strong acid to form a salt. The following structure illustrates such a salt formed between an LAS acid and a tertiary ethoxylated amine:

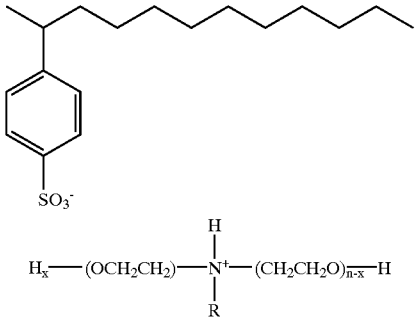

wherein: R=straight or branched alkyl group having from about 8 to about 22 carbon atoms;

n=total moles of ethoxylation and is from about 2 to about 30; and x=from about 1 to about 29.

In one particular example of this embodiment, an ethoxylated amine may be a tertiary tallow amine ethoxylate in which R=straight or branched alkyl group having from about 16 to about 18 carbon atoms; n=from about 5 to about 20; and x=from about 4 to about 19.

In one particular example of this embodiment, an ethoxylated amine may be a tertiary tallow amine ethoxylate in which R=straight or branched alkyl group having from about 16 to about 18 carbon atoms; n=from about 5 to about 20; and x=from about 4 to about 19. Still other examples of suitable ethoxylated tertiary amines include ethoxylated tertiary amines having some propylene oxide or other alkoxide content. For example, "R" in the previously given tertiary ethoxylated amine formula may be an alkyl group as defined above, or alternatively, a combination of an alkyl group as defined above and an alkoxide group, with the alkyl group being bound to the nitrogen atom. In another example, "R" in the preceding tertiary amine formula may be a combination of an alkyl group as defined above and an alkylaryl, with the alkyl group being bound to the nitrogen atom. In yet another embodiment, an alkoxylated tertiary amine may be of the above formula, with the exception that one or more of the x and/or (n-x) ethylene oxide groups may be replaced with one or more propylene oxide groups, other alkylene oxide groups, or mixtures thereof.

Specific examples of suitable ethoxylated tertiary amines may also be found in Table 1.

TABLE 1

Examples of Ethoxylated Tertiary Amines Available from Huntsman

| Trademark | Product | Theoretical Molecular Weight | Total Amine (meq/g) |
|---|---|---|---|
| SURFONIC ® | T-2 | 350 | 2.75–3.10 |
| | T-5 | 490 | 1.96–2.13 |
| | T-10 | 710 | 1.37–1.49 |
| | T-12 | 798 | 1.23–1.28 |
| | T-15 | 908 | 1.05–1.12 |
| | T-20 | 1150 | 0.89–0.94 |
| | T-50 | 2470 | .39–.42 |

As shown in Table 1, specific examples of suitable ethoxylated amines include, but are not limited to, ethoxylated amines of the "SURFONIC®" series available from Huntsman including, but not limited to, T-2, T-5, T-10, T-15, T-20, and T-50, wherein the numerical suffix indicates moles of ethoxylation per molecule. These tallow-amine-ethoxylates are of the type that may be represented by the formula:

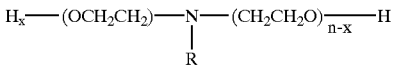

wherein: R=straight or branched alkyl group having from about 16 to about 18 carbon atoms;

n=moles of ethoxylation and is equivalent to the numerical suffix following the "T" (i.e., 2, 5, 10, 15, 20, 50, etc.); and x and (n-x) represent number of ethylene oxide groups in separate chains on the molecule.

Examples of other suitable alkoxylated tertiary amines may be found in Table 2.

TABLE 2

| Trademark | Product | Chemical Description | Equivalent Weight (Minimum/Maximum) |
|---|---|---|---|
| "ETHOMEEN" Ethoxylated Amines | C/12 | Ethoxylated (2) Cocoalkylamine | 280/300 |
| | C/15 | Ethoxylated (5) Cocoalkylamine | 410/435 |
| | C/20 | Ethoxylated (10) Cocoalkylamine | 620/660 |
| | C/25 | Ethoxylated (15) Cocoalkylamine | 830/890 |
| | O/12 | Ethoxylated (2) oleylamine | 343/363 |
| | O/15 | Ethoxylated (5) oleylamine | 470/495 |
| | T/12 | Ethoxylated (2) tallowalkylamine | 340/360 |
| | T/15 | Ethoxylated (5) tallowalkylamine | 470/495 |
| | T/25 | Ethoxylated (15) tallowalkylamine | 890/950 |
| | S/12 | Ethoxylated (2) soyaalkylamine | 342/362 |
| | S/15 | Ethoxylated (5) soyaalkylamine | 470/495 |
| | S/20 | Ethoxylated (1) soyaalkylamine | 685/725 |
| | S/25 | Ethoxylated (15) soyaalkylamine | 895/955 |
| | 18/12 | Ethoxylated (2) octadecylamine | 350/370 |
| | 18/15 | Ethoxylated (5) octadecylamine | 480/505 |
| | 18/20 | Ethoxylated (10) octadecylamine | 690/730 |
| | 18/25 | Ethoxylated (15) octadecylamine | 900/960 |
| | 18/60 | Ethoxylated (50) octadecylamine | 2370/2570 |
| "ETHODUOMEEN" Ethoxylated Diamines | T/13 | Ethoxylated (3) N-tallow-1,3-diaminopropane | 220/250 |
| | T/20 | Ethoxylated (10) N-tallow-1,3-diaminopropane | 375/405 |
| | T/25 | Ethoxylated (15) N-tallow-1,3-diaminopropane | 485/515 |
| "PROPROMEEN" Propoxylated Amines | C/12 | N-cocoalkyl-1-1'-iminobis-2-propanol | 308/318 |
| | O/12 | N-oleyl-1,1'-iminobis-2-propanol | 371/391 |
| | T/12 | N-tallowalkyl-1,1'-iminobis-2-propanol | 373/383 |

Other examples of specific suitable ethoxylated tertiary amines include, but are not limited to, Varonic T-215 available from Witco Corporation, Greenwich, Conn. and compositions available from Akzo Nobel.

Similar salts may be formed between anionic surfactants and alkoxylated secondary amines, such as ethoxylated amines having the following formula:

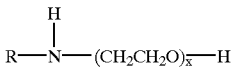

wherein: R=straight or branched alkyl group having from about 8 to about 22 carbon atoms;

x=from about 1 to about 30.

In one particular example of this embodiment, an ethoxylated amine may be a secondary tallow amine ethoxylate in which R=straight or branched alkyl group having from about 16 to about 18 carbon atoms; and x=from about 5 to about 20.

In general, the secondary amine ethoxylates are present in small amount in the tertiary amine ethoxylates and may not be sold separately as commercial products.

Similar salts may be formed between anionic surfactants and ethoxylated primary amines having the following formula:

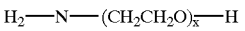

wherein: x=from about 1 to about 30.

In one particular example of this embodiment, a primary ethoxylated amine may be one in which x=from about 2 to about 20. Examples include, but are not limited to, DIGLYCOLAMINE™" available from Huntsman (2-(2-aminoethoxy) ethanol).

It will be understood with benefit of this disclosure by those of skill in the art that specific types and molecular weights of amines may be selected to fit particular purposes. For example, relatively shorter chain tertiary amine ethoxylates, like Huntsman T-2 and T-5, may be used to improve mineral oil detergency (e.g., motor oil, grease, etc.), while relatively longer chain tertiary amine ethoxylates, like Huntsman T-10 and T-15, may be used to improve trigylceride detergency (e.g., cooking oils, fats, etc.).

Alkoxylated ether amines (such as ethoxylated ether amine) surfactants may also be used, and include those having the following formula:

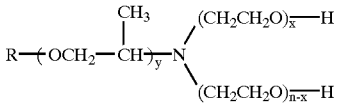

wherein: R=straight or branched alkyl group having from about 8 to about 22 carbon atoms;

n=total moles of ethoxylation and is from about 2 to about 30; and x=from about 1 to about 29; and y=1 to 30.

In one particular example of this embodiment, an ethoxylated amine may be a tertiary tallow amine ethoxylate in which R=straight or branched alkyl group having from about 12 to about 14 carbon atoms; n=from about 5 to about 20; and x=from about 4 to about 19; and y=1 to about 20.

Specific examples of suitable alkoxylated ether amines (such as ethoxylated ether amines) etc., may be found in Tables 3 and 4. Such amines may be primary, secondary or tertiary ethoxylated ether amines. Examples include, but are not limited to, ethoxylated ether amines of the "Surfonic PEA™" series available from Huntsman Corporation including, but not limited to, "Surfonic PEA-25™" ethoxylated linear polyetheramine, wherein the two digits of the numerical suffix indicates the moles of propoxylation and ethoxylation per molecule respectively. As shown in Table 4, other examples of suitable ethoxylated ether amines include, but are not limited to, E-17–5 available from Tomah Products, Milton, Wis.

TABLE 3

Examples of Ethoxylated Ether Amines Available from Huntsman

| Trademark | Product | Molecular Weight | Total Amine (meq/g) |
|---|---|---|---|
| SURFONIC ® | PEA-25 | 547 | 1.69–1.96 |

As shown in Table 3, specific examples of suitable ethoxylated ether amines include, but are not limited to, an ethoxylated ether amine of the "SURFONIC®" series available from Huntsman known as "PEA-25", wherein the numerical suffices indicate moles of propoxylation and ethoxylation, respectively, per molecule. These ethoxylated amines are of the type that may be represented by the formula:

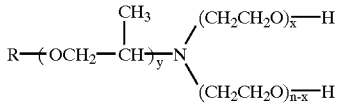

wherein: R=straight or branched alkyl group having from about 12 to about 14 carbon atoms;

n=total moles of ethoxylation and is equivalent to the second numerical suffix (5 for "PEA-25");

y=total moles of propoxylation and is equivalent to the first numerical suffix (2 for "PEA-25"); and x and (n-x) represent number of ethylene oxide groups in separate chains on the molecule.

TABLE 4

Examples of Ethoxylated Ether Amines Available from Tomah

| Product | Chemical Description | Molecular Weight | Minimum Amine Value |
|---|---|---|---|
| E-14-2 | Bis-(2-hydroxyethyl) isodecyloxypropyl amine | 310 | 175 |
| E-14-5 | Poly (5) oxyethylene isodecyloxypropyl amine | 445 | 123 |
| E-17-2 | Bis-(2-hydroxyethyl) isotridecyloxypropyl amine | 345 | 155 |
| E-17-5 | Poly (5) oxyethylene isotridecyloxypropyl amine | 485 | 112 |
| E-19-2 | Bis-(2-hydroxyethyl) $C_{12}/C_{15}$ alkyloxypropyll amine | 350 | 150 |
| E-22-2 | Bis-(2-hydroxyethyl) Octadecyloxypropyl amine | 450 | 120 |

In one embodiment, an amount of an ethoxylated surfactant (such as ethoxylated amine and/or ethoxylated ether amine) sufficient or effective to neutralize the acid functionality of the anionic surfactant is employed, although greater or lesser amounts are also possible. The total amount of surfactant actives present in a surfactant composition may be any effective or suitable amount to form a concentrated or diluted surfactant composition. In one embodiment, the total amount of surfactant actives may range from about 1% to about 100% by weight of the total weight of the composition, alternatively from about 10% to about 100% by weight of the total weight of the composition, alternatively from about 10% to about 90% by weight of the total weight of the composition.

In exemplary embodiments, ethoxylated amine (either a single ethoxylated amine or a mixture of ethoxylated amines) may be present in a surfactant composition in an amount of greater than 15% of the surfactants actives by weight, alternatively from 15% to about 50% of the surfactant actives by weight, alternatively from 15% to about 35% of the surfactant actives by weight, alternatively greater than about 16% of the surfactant actives by weight, alternatively from about 16% to about 50% of the surfactant actives by weight, alternatively from about 16% to about 35% of the surfactant actives by weight, alternatively greater than about 17% of the surfactant actives by weight, alternatively from about 17% to about 50% of the surfactant actives by weight, alternatively from about 17% to about 35% of the surfactant actives by weight, alternatively greater than about 18% of the surfactant actives by weight, alternatively from about 18% to about 50% of the surfactant actives by weight, alternatively from about 18% to about 35% of the surfactant actives by weight, alternatively greater than about 19% of the surfactant actives by weight, alternatively from about 19% to about 50% of the surfactant actives by weight, alternatively from about 19% to about 35% of the surfactant actives by weight, alternatively greater than about 20% of the surfactant actives by weight, alternatively from about 20% to about 50% of the surfactant actives by weight, and alternatively from about 20% to about 35% of the surfactant actives by weight.

In separate respective and alternative embodiments, ethoxylated amine (either a single ethoxylated amine or a mixture of ethoxylated amines) may be present in a surfactant composition in an amount of from about x% to about y% of the surfactant actives by weight, where for each respective embodiment the value of x may be selected from the range of values of from 1 to 59 and a corresponding value of y may be selected from the range of values of from 2 to 60, with the proviso that x is less than y for a given embodiment. For example, in an embodiment where x=20 and y=31, a surfactant composition having an amount of ethoxylated amine of from about 20% to about 31% of the surfactant actives by weight would be represented.

Suitable anionic surfactants that may be employed include any anionic surfactant suitable for forming a salt with the ethoxylated amines and/or ethoxylate ether amines disclose herein. Typically, such anionic surfactant may be characterized as having pKa values less than 7. For example, suitable anionic surfactants include, but are not limited to, linear and/or branched chain alkylbenzene sulfonates, alkyl sulfates, ether sulfates, secondary alkyl sulfates, α-olefin sulfonates, phosphate esters, sulfosuccinates, isethionates, carboxylates, etc. Most of these surfactants are typically sold in the form of a sodium salt.

In one exemplary embodiment, one or more alkylbenzene sulfonate/s may be employed as anionic surfactants. In this regard, alkylbenzene sulfonate compounds having varying molecular weights, alkyl chain length and alkyl chain phenyl location combination may be employed. Examples of such compounds may be found in U.S. Pat. No. 3,776,962; U.S. Pat. No. 5,152,933; U.S. Pat. No. 5,167,872; Drazd, Joseph C. and Wilma Gorman, "Formulating Characteristics of High and Low 2-Phenyl Linear Alkylbenzene Sulfonates in Liquid Detergents," *JAOCS*, 65(3):398404, March 1988; Sweeney, W. A. and A. C. Olson, "Performance of Straight-Chain Alkylbenzene Sulfonates (LAS) in Heavy-Duty Detergents," *JAOCS*, 41:815–822, December 1964.; Drazd, Joseph C., "An Introduction to Light Duty (Dishwashing) Liquids Part I. Raw Materials," *Chenlical Times & Trends*, 29–58, January 1985; Cohen, L. et al., "Influence of 2-Phenyl Alkane and Tetralin Content on Solubility and Viscosity of Linear Alkylbenzene Sulfonate," *JAOCS*, 72(1):115–122, 1995; Smith, Dewey L., "Impact of Composition on the Performance of Sodium Linear Alkylbenzenesulfonate (NaLAS)," *JAOCS*, 74(7):837–845, 1997; van Os, N. M. et al., "Alkylarenesulphonates: The Effect of Chemical Structure on Physico-chemical Properties," *Tenside Surif Det*., 29(3):175–189, 1992; Moreno, A. et al., "Influence of Structure and Counterions on Physicochemical Properties of Linear Alkylbenzene Sulfonates," *JAOCS*, 67(8):547–552, August 1990; Matheson, K. Lee and Ted P. Matson, "Effect of Carbon Chain and Phenyl Isomer Distribution on Use Properties of Linear Alkylbenzene Sulfonate: A Comparison of 'High' and 'Low' 2-Phenyl LAS Homologs," *JAOCS*, 60(9):1693–1698, September 1983; Cox, Michael F. and Dewey L. Smith, "Effect of LAB composition on LAS Performance," *INFORM*, 8(1):19–24, January 1997; U.S. patent application Ser. No. 08/598,692 filed on Feb. 8, 1996, U.S. patent application Ser. No. 09/141,660 filed on Aug. 28, 1998, and U.S. patent application Ser. No. 09/143,177 filed on Aug. 28, 1998; all of the foregoing references being incorporated herein by reference in their entirety.

In one embodiment, alkylbenzene sulfonate compounds used in accordance with the disclosed compositions and methods and having the characteristics described herein include those having a linear alkyl group. Typically linear alkyl chain lengths are between about 8 and about 16 carbon atoms, although greater and lesser lengths are possible.

In the practice of the disclosed method and compositions, an alkylbenzene sulfonate may include any counterion or cation suitable for neutralization. In one embodiment a counterion or cation is typically ammonium or substituted ammonium. In this regard, a substituted ammonium may include, but is not limited to, monoethanol ammonium, diethanol ammonium, triethanol ammonium, or a mixture thereof. In another embodiment, such a counterion or cation may be an alkali metal, an alkaline earth metal, or a mixture thereof. Typical alkali metals include, but are not limited to, lithium, sodium, potassium, cesium, or a mixture thereof. Typical alkaline earth metals include, but are not limited to, magnesium, calcium, strontium, barium, or a mixture thereof.

One specific low 2-phenyl alkylbenzene sulfonate composition is a sulfonate prepared from a linear alkyl benzene known as ALKYLATE225™ (commercially available from Huntsman Specialty Chemicals Corporation). Other examples of suitable linear alkylbenzenes for preparing linear alkyl benzene sulfonates include, but are not limited to, ALKYLATE 215™, ALKYLATE 229™, ALKYLATE H230L™, and ALKYLATE H230H™ (also available from Huntsman Specialty Chemicals Corporation). Suitable processes for sulfonating such linear alkyl benzenes include, but are not limited to, those employing an air/$SO_3$ sulfonator or chlorosulfonic acid.

Examples of other suitable anionic surfactant types include, but are not limited to, alkyl sulfates, ether sulfates, secondary alkyl sulfates, α-olefin sulfonates, xylene sulfonates, alcohol sulfates, phosphate esters, naptbalene sulfonates, sulfosuccinates, isethionates, carboxylates, etc.

Specific examples of other suitable anionic surfactants include, but are not limited to, the surfactants listed in Table 5 and available from Huntsman Corporation, Houston, Tex.

TABLE 5

Examples of Anionic Surfactants Available from Huntsman

| Anionic Surfactant Type | Product Name |
|---|---|
| DETERGENT SULFATES/ | Nonasol LD-50, Nonasol N4SS, Sulfonic Acid LS, Surfonic SB-N4AS ®, Surfonic |

TABLE 5-continued

Examples of Anionic Surfactants Available from Huntsman

| Anionic Surfactant Type | Product Name |
|---|---|
| SULFONATES | SNS-60 ®, Surfonic SNS-40 ® |
| PHOSPHATE ESTERS | Agphos ™ 7140, Surfonic PE-1168, Surfonic PE-1178 ®, Surfonic PE ®, Surfonic PE-1218 ®, Surfonic PE-2188 ®, Surfonic PE-2208 ®, Surfonic PE-2258 ®, Surfonic PE-JV-05-015 ®, Surfonic PE-BP-2 ®, Surfonic PE-25/97 ® |
| SULFONATES | SXS-40, PSA, XSA-80, XSA-90, XSA-95 |
| SULFOSUCCINATES | Surfonic DOS-40; Surfonic DOS-60; Surfonic DOS-70E; Surfonic DOS-70MS; Surfonic DOS-75; Surfonic DOS-75PG |
| ISETHIONATE | Surfonic SI |

Still other specific examples of suitable anionic surfactants include, but are not limited to, the surfactants listed in Table 6 available from Witco Corporation, Greenwich, Conn.

TABLE 6

Examples of Anionic Surfactants Available from Witco

| PRODUCT | DESCRIPTION |
|---|---|
| WITCONATE ™ | Alkylbenzene, Alpha Olefin, and Xylene Sulfonates |
| WITCO ® | Alkylbenzene Sulfonic Acid and Slurries |
| WITCOLATE ™ | Alcohol Sulfates and Ether Sulfates |
| EMPHOS ™ | Phosphate Esters |
| PETRO ® | Naphthalene Sulfonate Hydrotopes |
| EMCOL ® | Speciality Anionic Surfactants |
| Witco Workhorse Surfactants/Hydrotropes Anionics | Linear Alkyl Benzene Sulfonates (LAS); Alcohol Sulfates (AS); Alcohol Ether Sulfates (AES), Alpha Olefin Sulfonates (AOS), Sodium Xylene Sulfonate (SXS) |
| Witco Specialty Surfactants/Hydrotropes Anionics | Sulfosuccinates, Ether Carboxylates, Naphthalene Sulfonates, Phosphate Esters |
| WITCONATE 90 Flakes | Sodium Alkylbenzene Sulfonate |
| WITCONATE Slurries | Sodium Alkylbenzene Sulfonate |
| WITCONATE 1298SA | Sodium Alkylbenzene Sulfonic Acid |
| WITCONATE 45 Liquid | Sodium Alkylbenzene Sulfonate & SXS |
| WITCONATE 60T Liq. | TEA-Dodecylbenzene Sulfonate |
| WITCOLATE WAC-LA | Sodium Lauryl Sulfate |
| WITCOLATE A Powder | Sodium Lauryl Sulfate |
| EMCOL 4161L | Sodium oleylalkanolamido sulfosuccinate |
| WITCOLATE SE-5 | Sodium Pareth-25 (Ether) Sulfate (3EO) |
| WITCOLATE LES-60C | Sodium Lauryl Ether Sulfate (3EO) |
| WITCOLATE-AE-3 | Ammonium Pareth-25 (Ether) Sulfate |
| WITCOLATE LES-60a | Ammonium Laureth (Ether) Sulfate |
| WITCOLATE ES-370 | Sodium Lauryl Ether Sulfate (3EO) |
| WITCOLATE AOS | Sodium Alpha Olefin Sulfonate |
| WITCOLATE AOK | Sodium Alpha Olefin Sulfonate |
| WITCONATE 93S | Isopropylamine of Dodecylbenzene Sulfonate |
| WITCONATE P-1059 | Isopropylamine of Dodecylbenzene Sulfonate |
| EMCOL CNP 110 | Alkylaryl Ethoxylated Carboxylate |
| EMCOL CLA 40 | C12–14 Ethoxylated Carboxylic Acid |
| WITCONATE SXS Liq. | Sodium Xylene Sulfonate |
| WITCONATE SXS FL | Sodium Xylene Sulfonate |
| WITCONATE NAS-8 | Sodium Octyl Sulfonate |
| PETRO BA | Sodium Alkyl Naphthalene Sulfonate |
| PETRO BAF | Sodium Alkyl Naphthalene Sulfonate |
| Ether Carboxylate Anionic Surfactant | Emcol CNP-40, Emcol CNP-60, Emcol CNP-100, Emcol CNP-110, Emcol CNP-120, Emcol CLA-40, Emcol CBA-50, Emcol CBA-60, Emcol CBA-100, Structure: |

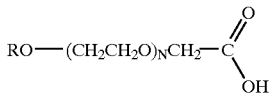

TABLE 6-continued

| Examples of Anionic Surfactants Available from Witco | |
|---|---|
| PRODUCT | DESCRIPTION |
| | RO = nonylphenol, DO/tetradecanol, tridecanol, ethylhexanol<br>n = 3, 4, 5, 6 or 10 |

Still other specific examples of anionic surfactants include, but are not limited to, the surfactants listed in Table 7 and available from Stepan Company.

TABLE 7

| Examples of Anionic Surfactants Available from Stepan | |
|---|---|
| Product | Chemical Description |
| ALPHA SULFO METHYL ESTERS | |
| Alpha-Step ML-40 ® | Sodium methyl 2-sulfolaurate and disodium 2-sulfolaurate |
| Alpha-Step MC-48 ® | Sodium methyl 2-sulfo $C_{12}$–$C_{18}$ ester and disodium 2-sulfo $C_{12}$–$C_{18}$ fatty acid salt |
| ALKYLBENZENE SULFONATES | |
| Bio-Soft D-40 ® | Sodium alkylbenzene sulfonate, linear |
| Bio-Soft D-62 ® | Sodium alkylbenzene sulfonate, linear |
| Bio-Soft N-300 ® | TEA-Dodecylbenzene sulfonate |
| NACCONOL 40G ® | Sodium alkylbenzene sulfonate, linear |
| NACCONOL 90G ® | Sodium alkylbenzene sulfonate, linear |
| Ninate 401 ® | Calcium alkylbenzene sulfonate, branched |
| Bio-Soft N-411 ® | Amine alkylbenzene sulfonate, linear |
| SULFONIC ACIDS | |
| Bio-Soft S-100 ® | Alkylbenzene sulfonic acid, linear |
| Bio-Soft S-126 ® | Alkylbenzene sulfonic acid, linear |
| Stepantan H-100 ® | Alkylbenzene sulfonic acid, branched |
| HYDROTROPES | |
| Stepanate SXS ® | Sodium xylene sulfonate |
| Stepanate AXS ® | Ammonium xylene sulfonate |
| Stepanate SCS ® | Sodium cumene sulfonate |
| PHOSPHATE ESTERS | |
| Cedephos FA-600 ® | Alkyl ether phosphate |
| Stepfac 8170 ® | Alkylaryl ether phosphate |
| SPECIALTIES | |
| Bio-Terge PAS-8S ® | Sodium alkane sulfonate |
| ALKYL SULFATES | |
| Stepanol WA-extra ® | Sodium lauryl sulfate |
| Stepanol WAC ® | Sodium lauryl sulfate |
| Stepanol WA-special ® | Sodium lauryl sulfate |
| Stepanol ME-dry ® | Sodium lauryl sulfate |
| Stepanol AM ® | Ammonium lauryl sulfate |
| Stepanol AM-V ® | Ammonium lauryl sulfate |
| ALKYL ETHER SULFATES | |
| Steol 4N ® | Sodium laureth sulfate |
| Steol CS-460 ® | Sodium laureth sulfate |
| Steol CA-460 ® | Ammonium laureth sulfate |
| Steol KS-460 ® | Sodium laureth sulfate, modified |
| Steol KA-460 ® | Ammonium laureth sulfate, modified |

It will be understood with benefit of this disclosure by those of skill in the art that the foregoing examples of anionic surfactants are exemplary only, and that other anionic surfactants meeting the criteria set forth herein may also be employed.

In one embodiment, an amount of anionic surfactant sufficient to neutralize the ethoxylated amine surfactant is employed, although greater or lesser amounts are also possible.

As described above, embodiments of the disclosed surfactant compositions include anionic surfactants/s blended with ethoxylated amine, ethoxylated ether amine, or mixtures thereof. However, a wide variety of other optional ingredients may also be added if so desired. For example, one or more nonionic surfactant/s may also be added for the purpose of purpose of lowering the mixture viscosity, and without destroying the salt. In this regard, any nonionic surfactant or mixture thereof suitable for lowering the pour point may be employed. In one embodiment, an amount of nonionic surfactant sufficient to dissolve the anionic-ethoxylated amine surfactant is employed, although greater or lesser amounts are also possible.

Examples of suitable nonionic surfactant types include, but are not limited to, nonylphenol ethoxylates, alcohol ethoxylates, ethylene oxide/propylene oxide ("EO—PO") block copolymers, and mixtures thereof. Specific examples include, but are not limited to, nonylphenol ethoxylates such as "SURFONIC N95™" available from Huntsman and linear alcohol ethoxylates such as "SURFONIC L24-7™" also available from Huntsman. Other specific examples include, but are not limited to, nonionic surfactants commercially available from Huntsman Corporation and Witco, as described below.

Specific examples of suitable nonionic surfactants available from Huntsman Corporation include, but are not limited to, surfactants listed in Table 8.

TABLE 8

| Examples of Nonionic Surfactants Available from Huntsman | |
|---|---|
| ALCOHOL ETHOXYLATES | |
| Linear Alcohol Ethoxylates | L-series Biodegradation, Surfonic ® L610-3, Surfonic L108/85-5, Surfonic L1270-2, Surfonic L12/85-2, Surfonic L12-2.6, Surfonic L12-6, Surfonic L12-8, Surfonic L24-1.3, Surfonic L24-2, Surfonic L24-3, Surfonic L24-4, Surfonic L24-4.4, Surfonic L24-5, Surfonic L24-7, Surfonic L24-9, Surfonic L24-12, Surfonic L24-17, Surfonic L24-22, Surfonic L46-7, Surfonic L68-18, Surfonic HF-055 |
| Branched Alcohol Ethoxylates | Surfonic AE-2, Surfonic DA-4, Surfonic DA-6, Surfonic EH-2, Surfonic TDA-3B, Surfonic TDA-6, Surfonic TDA-8, Surfonic TDA-8/90, Surfonic TDA-8.4, Surfonic TDA-9, Surfonic TDA-11, Surfonic DDA-3, Surfonic DDA-6, Surfonic DDA-8, Surfonic DDA-12 |
| ALKYLPHENOL ETHOXYLATES | |
| Nonylphenol Ethoxylates | Surfonic N-Series Biodegradation, Surfonic N-10, Surfonic N-31.5, Surfonic N-40, Surfonic N-60, Surfonic N-70, Surfonic N-80, Surfonic N-85, Surfonic N-95, Surfonic N-100, Surfonic N-102, Surfonic N-110, Surfonic N-120, Surfonic N-150, Surfonic NB-158, Surfonic NB-189, Surfonic N-200, Surfonic N-300, Surfonic NB-307, Surfonic N400, Surfonic NB-407, Surfonic N-500, Surfonic NB-507, Surfonic N-550, Surfonic NB-557, Surfonic N-700, Surfonic N-800, Surfonic N-1000; Surfonic NB-1007 |
| Octylphenol Ethoxylates | Surfonic OP-15, Surfonic OP-35, Surfonic OP-50, Surfonic OP-70, Surfonic OP-100, Surfonic OP-120, Surfonic OPB-167, Surfonic OPB-307, Surfonic OP-400, Surfonic OPB-407, Surfonic OPB-707 |
| Dodecylphenol Ethoxylates | Surfonic DDP-40, Surfonic DDP-50 (draft), Surfonic DDP-60, Surfonic DDP-70 (draft), Surfonic DDP-80 |

TABLE 8-continued

| Examples of Nonionic Surfactants Available from Huntsman | |
|---|---|
| | (draft), Surfonic DDP-90, Surfonic DDP-100 (draft), Surfonic DDP-110 (draft), Surfonic DDP-120 (draft), Surfonic DDP-140 (draft) |
| Dinonylphenol Ethoxylates | Surfonic DNP-15 (draft), Surfonic DNP-20 (draft), Surfonic DNP-40 (draft), Surfonic DNP-70 (draft), Surfonic DNP-80 (draft), Surfonic DNP-100 (draft), Surfonic DNP-140 (draft), Surfonic DNP-180 (draft), Surfonic DNP-240 (draft), Surfonic DNP-490 (draft), Surfonic DNP-550 (draft), Surfonic DNP-700 (draft), Surfonic DNP-1000 (draft), Surfonic DNP-1500 (draft) |
| ALCOHOL OR ALKYLPHENOL ALKOXYLATES (EO/PO) | |
| | Surfonic LF-17, Surfonic LF-18, Surfonic LF-37, Surfonic LF-40, Surfonic LF-41, Surfonic LF-47, Surfonic LF-50, Surfonic LF-68, Surfonic LF-0312, Surfonic JL-80X, Surfonic JL-80X-B1, Surfonic JL-25X, Surfonic P-1, Surfonic P-3, Surfonic P-5, Surfonic P-6, Defoamer PM, Surfonic L4-29X |
| EO/PO BLOCK COPOLYMERS | |
| | Surfonic POA-L42, Surfonic POA-L44, Surfonic POA-L61, Surfonic POA-L62, Surfonic POA-L62LF, Surfonic POA-L64, Surfonic POA-L81, Surfonic POA-L101, Surfonic POA-25R2, Surfonic POA-LF1, Surfonic POA-LF2, Surfonic POA-LF5 |
| POGOL PEGS | |
| | Pogol 200, Pogol 300, Pogol 400, Pogol 500, Pogol 600, Pogol 900, Pogol 1000, Pogol 1005, Pogol 1450, Pogol 1457 |
| SURFONIC ALKYLPHENOL ETHOXYLATES | |
| | N-10, N-31.5, N-40, N-60, N-85, N-95, N-100, N-102, N-120, N-150, N-200, N-300, NB-307, N-400, NB-407, N-550, NB-557, N-700, N-800, N-1000, OP-15, OP-35, OP-50, OP-70, OP-100, OP-120, OPB-307, OP-400, OP-407, OPB-707, DDP-40, DDP-50, DDP-60, DDP-70, DDP-80, DDP-90, DDP-100, DDP-110, DDP-120, DDP-140, DNP-15, DNP-20, DNP-40, DNP-70, DNP-80, DNP-100, DNP-150, DNP-180, DNP-240, DNP-490, DNP-550, DNP-700, DNP-1000, DNP-1500 |
| SURFONIC L SERIES LINEAR ALCOHOL ETHOXYLATES | |
| Surfonic Product | L610-3, L108/85-5, L1270-2, L1285-2, L12-3, L12-6, L12-8, L24-1.3, L24-3, L24-4, L24-7, L24-9, L24-12, L46-7, L68-18 |

TABLE 8-continued

| Examples of Nonionic Surfactants Available from Huntsman | |
|---|---|
| SURFONIC TDA AND DA SERIES ETHOXYLATES | |
| Surfonic Product | DA-4, DA-6, TDA-6, TDA-8, TDA-9 |

Examples of suitable nonionic surfactants also include products available from Witco. Such products include, for example, WITCONOL™ linear ethoxylated alcohols, DESONIC™ alkylphenol ethoxylates, WITCAMIDE® and VARAMIDE™ amide ether condensates, and VARONIC™ coco and tallow amine ethoxylates. Some specific examples of such surfactants are listed in Table 9. Other nonionic materials include, but are not limited to, alcohol ethoxylates ("AE"), nonylphenol ethoxylates ("NPE"), ethoxylated mono and diglycerides, ethoxylated amines, amides, amine oxides and specialty blends.

TABLE 9

Examples of Amphoteric and Nonionic Surfactants Available from Witco
AMPHOTERIC AND NONIONIC SURFACTANTS

| Product Tradename | Description |
|---|---|
| REWOTERIC AMB 12P | Cocoamidopropyl Dimethyl Betaine |
| REWOTERIC AM B14 | Cocoamidopropyl Dimethyl Betaine |
| REWOTERIC AM 2C 2 | Disodium Coco Amphodiacetate |
| REWOTERIC AM TEG | Tallow Glycinate |
| REWOTERIC AM CAS | Cocoamidopropyl Hydroxy Sultaine |
| REWOTERIC AM KSF40 | Coco Amphopropionate |
| REWOTERIC AMV | Sodium Capryloamphoacetate |
| WITCAMIDE 128T | Cocoamide DEA |
| WITCONOL 12-3 | C12/C15 Alcohol Ethoxylate (3EO) |
| WITCONOL 12-7 | C12/C15 Alcohol Ethoxylate (7EO) |
| WITCONOL 12-6 | C12/C14 Alcohol Ethoxylate (6EO) |
| DESONIC 9N | Nonylphenol + 9 EO |
| VARONIC K-205 | PEG 5 Cocamine |
| VARONIC K-210 | PEG 10 Cocamine |
| VARONIC T-210 | PEG 10 Tallow Amine |
| VARONICK T-215 | PEG 15 Tallow Amine |

Specific examples of suitable nonionic surfactants available from Stepan include, but are not limited to, surfactants listed in Table 10.

TABLE 10

Examples of Nonionic Surfactants Available from Stepan
ALKOXYLATES

| | | | | |
|---|---|---|---|---|
| MAKON 4 | Nonlyl Phenol Ethoxylate | 100 | Liquid | Detergents and emulsifiers |
| MAKON 6 | Nonlyl Phenol Ethoxylate | 100 | Liquid | differing in ethylene oxide |
| MAKON 8 | Nonlyl Phenol Ethoxylate | 100 | Liquid | content. Makon 4 is the |
| MAKON 10 | Nonlyl Phenol Ethoxylate | 100 | Liquid | most oil-soluble. Makon |

TABLE 10-continued

| Examples of Nonionic Surfactants Available from Stepan ALKOXYLATES | | | | |
|---|---|---|---|---|
| MAKON 12 | Nonlyl Phenol Ethoxylate | 100 | Liquid | 12 is the least oil soluble. |
| MAKON OP-9 | Octyl Phenol Ethoxylate | 100 | Liquid | Emulsifier, detergent dispersant, and wetting agent. |
| MAKON NF-5 | Polyalkoxylated Amide | 100 | Liquid | Non-foaming wetting agents for mechanical dishwash detergents and metal cleaning. |
| MAKON NF-12 | Polyalkoxylated Aliphatic Base | 100 | Liquid | |
| AMIDOX L-5 | PEG-6 Lauramide | 100 | Solid | Emulsifiers, detergents, wetting agents that have some of the properties of both alkanolamides and nonionic type surfactants. |
| AMIDOX C-5 | PEG-6 Cocamide | 100 | Liquid | |
| BIO-SOFT EA-8 | Alkoxylated Alcohol | 100 | Liquid | Emulsifiers and detergents differing in ethylene oxide content. |
| BIO-SOFT EA-10 | Alkoxylated Alcohol | 100 | Liquid | |
| NEUTRONY X656 | Nonyl Phenol Ethoxylate | 100 | Liquid | Detergent and emulsifier for hard surface detergents. |

If desired, neutralization of anionic surfactants in the disclosed surfactant compositions may be accomplished with the addition of a basic compound. Examples of such optional neutralizing compounds include, but are not limited to, alkanolamines, alkyl amines, ammonium hydroxide, NaOH, KOH, and mixtures thereof Amounts of neutralizing compound may be any amount suitable for partially or completely neutralizing an anionic surfactant acid. In one embodiment, an amount of neutralizing compound sufficient to neutralize about 75% of the anionic surfactant is employed, although greater or lesser amounts are also possible. Sufficient alkoxylated amine may be employed in conjunction with the neutralization compound to neutralize about 25% of the anionic surfactant.

In the formulation and practice of the disclosed compositions and methods, a viscosity modifier may be employed suitable to prevent gel phase formation upon dilution. Examples of suitable modifiers compounds include polyethylene glycols, ethylene glycol, propylene glycol, and mixtures thereof Examples of suitable polyethylene glycol compounds include, but are not limited to, polyethylene glycol compounds having a molecular weight of between about 100 and about 1000, alternatively between 200 and about 400. Specific examples include one or more polyethylene glycol solubility enhancers having between about 1 and about 20, alternatively between about 3 and about 6 ethylene glycol monomers joined by ether linkages. Specific examples of such polyethylene glycol compounds include, but are not limited to, polyethylene glycol products marketed by Huntsman Chemical Corporation under the trade name POGOL™, and POGOL 300. In the case of POGOL™ compounds, the numeric designation indicates the average molecular weight of the polyethylene glycol compounds. Specific examples may be found in table 8. In one embodiment, an amount of viscosity modifier compound sufficient to obtain a low viscosity liquid is employed, although greater or lesser amounts are also possible.

The disclosed surfactant compositions may be provided in solid form without a solvent (which, for example, may be combined with a solvent later), or in liquid form with a solvent. In those embodiments employing solvents, any solvent suitable for use in the formulation of a liquid detergent formulation may be employed. Suitable solvents include, for example, those solvents capable of dissolving low 2-phenyl linear alkylbenzene sulfonates. Examples of suitable solvents include, but are not limited to, water, alcohols, glycols and glycol ethers, or mixtures thereof. Specific examples of suitable alcohol solvents include, but are not limited to, alcohols having from about 1 to about 6 carbon atoms. In the practice of the disclosed method and compositions, typical specific solvents include water, straight chain alkyl alcohols containing from one to six carbon atoms (example: methanol, ethanol, n-propanol, n-hexanol, etc.), branched chain alkyl alcohols containing from three to six carbon atoms (example: isopropanol and secondary butanol), glycols such as propylene glycol, diglycols such as propylene diglycol and triglycols such as triethylene glycol and glycol ethers such as butylene glycol diethylether and dipropylene glycol methylether. In one embodiment, an amount of solvent sufficient to obtain a low viscosity liquid is employed, although greater or lesser amounts are also possible.

In one embodiment, by employing propylene glycol a surfactant composition may be formulated to exist as a single or substantially homogenous liquid phase (without segregation) at about 40° F. using other components described elsewhere herein, but with substantially no water. In such an embodiment, propylene glycol may be present to substantially prevent separation or segregation of a composition at, for example, ambient temperatures. Such a formulation may be less corrosive than aqueous solutions and may allow shipping of a composition having substantially no excess weight due to water content.

In one particular embodiment, a surfactant concentrate composition may be formulated by blending together the components listed in Table 11.

TABLE 11

| Concentration Range (by weight of solution) | Component |
|---|---|
| about 8% to about 35% | LAS Acid |
| up to about 9% | Monoethanolamine |
| up to about 15% | Pogol 300 |
| about 8% to about 35% | Surfonic T-15 |
| About 15% to about 55% | Surfonic N-95 |
| About 10% to about 55% | Water |

Although one particular combination of components and weight percentages thereof has been listed in Tables 11, it will be understood with benefit of this disclosure that other combinations, other components as well as other weight percentages (including outside those ranges listed in Table 1), may be employed in the practice of the disclosed compositions.

EXAMPLES

The following examples are illustrative and should not be construed as limiting the scope of the invention or claims thereof.

Example 1

Ethoxylated Tertiary Amine/LAS Surfactant Composition

In this example, a surfactant concentrate is made by blending together the components listed in Table 12.

TABLE 12

| Concentration Range (by weight of solution) | Component |
|---|---|
| 17.4% | LAS Acid-prepared by air/$SO_3$ sulfonation of Huntsman "ALKYLATE 229 ™" |
| 2.4% | Monoethanolamine |
| 8% | Pogol 300 |
| 17.4% | Surfonic T-15 |
| 34.8% | Surfonic N-95 |
| 20% | Water |

The physical properties of the blend are shown in Table 13.

TABLE 13

| Characteristic | Value |
|---|---|
| pH (1%) | 8.5 |
| Solids | 80 |
| Viscosity (cps) | 575 |
| Color (Gardner) | 6 |

Advantageously, the blend may be diluted with water with no gel phase formation.

While the invention may be adaptable to various modifications and alternative forms, 10 specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed compositions and methods may be utilized in various combinations and/or independently. Thus the invention is not limited to only those combinations shown herein, but rather may include other combinations.

It will be understood with benefit of this disclosure that in structures where x and (n-x) are given herein to represent number of ethylene oxide groups in separate chains on a molecule, values of x and n may vary (for example, within the ranges given), to give a wide range of numerical distributions of ethylene oxide in separate chains of a molecule. However, in one embodiment, n and n-x may be substantially equal (or very close in value), representing a substantially symmetrical or normal distribution of number of ethylene oxide groups between two separate chains of a molecule.

REFERENCES

The following references, to the extent that they provide exemplary procedural or other details supplementary to those set forth herein, are specifically incorporated herein by reference.

U.S. Pat. No. 3,776,962

U.S. Pat. No. 5,152,933

U.S. Pat. No. 5,167,872

U.S. Pat. No. 5,719,118

U.S. patent application Ser. No. 08/598,692 filed on Feb. 8, 1996.

U.S. patent application Ser. No. 09/141,660 filed on Aug. 28, 1998.

U.S. patent application Ser. No. 09/143,177 filed on Aug. 28, 1998.

Cohen, L. et al., "Influence of 2-Phenyl Alkane and Tetralin Content on Solubility and Viscosity of Linear Alkylbenzene Sulfonate," *JAOCS*, 72(1):115–122, 1995.

Cox, Michael F. and Dewey L. Smith, "Effect of LAB composition on LAS Performance," *INFORM*, 8(1):19–24, January 1997.

Drazd, Joseph C. and Wilma Gorman, "Formulating Characteristics of High and Low 2-Phenyl Linear Alkylbenzene Sulfonates in Liquid Detergents," *JAOCS*, 65(3): 398–404, March 1988.

Drazd, Joseph C., "An Introduction to Light Duty (Dishwashing) Liquids Part I. Raw Materials," *Chemical Times & Trends*, 29–58, January 1985.

Matheson, K. Lee and Ted P. Matson, "Effect of Carbon Chain and Phenyl Isomer Distribution on Use Properties of Linear Alkylbenzene Sulfonate: A Comparison of 'High' and 'Low' 2-Phenyl LAS Homologs," *JAOCS*, 60(9):1693–1698, September 1983.

Moreno, A. et al., "Influence of Structure and Counterions on Physicochemical Properties of Linear Alkylbenzene Sulfonates," *JAOCS*, 67(8):547–552, August 1990.

Smith, Dewey L., "Impact of Composition on the Performance of Sodium Linear Alkylbenzenesulfonate (NaLAS)," *JAOCS*, 74(7):837–845, 1997.

Sweeney, W. A. and A. C. Olson, "Performance of Straight-Chain Alkylbenzene Sulfonates (LAS) in Heavy-Duty Detergents," *JAOCS*, 41:815–822, December 1964.

van Os, N. M. et al., "Alkylarenesulphonates: The Effect of Chemical Structure on Physico-chemical Properties," Tenside Surf Det., 29(3):175–189, 1992.

What is claimed is:

1. A surfactant composition, comprising:

a neutralization product that is formed within said composition from at least one anionic surfactant acid and at least one ethoxylated surfactant, said ethoxylated surfactant being at least one ethoxylated ether amine thereof; and a neutralizing compound, said neutralizing compound being employed in conjunction with said ethoxylated surfactant to neutralize said anionic surfactant acid;

wherein said ethoxylated surfactant is present in an amount less than sufficient to completely neutralize an amount of said anionic surfactant acid present; and wherein said neutralizing compound is present in an amount sufficient to partially neutralize an amount of said anionic surfactant acid present.

2. The surfactant composition of claim 1, wherein said ethoxylated surfactant comprises ethoxylated ether amine surfactant having the formula:

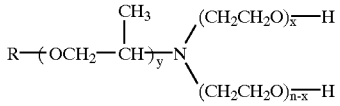

wherein: R=straight or branched alkyl group having from about 8 to about 18 carbon atoms;

n=from about 2 to about 30; and x=from about 1 to about 29 and y=1 to 30.

3. The surfactant composition of claim 1, further comprising nonionic surfactant.

4. The surfactant composition of claim 3, further comprising water.

5. The surfactant composition of claim 4, wherein said neutralizing compound comprises at least one of alkanolamine, alkylamine, ammonium hydroxide, NaOH, KOH, or a mixture thereof.

6. The surfactant composition of claim 5, wherein said alkanolamine comprises at least one of monoethanolamine, diethanolamine, triethanolamine or a mixture thereof.

7. The surfactant composition of claim 3, wherein said anionic surfactant acid comprises the acid form of at least one of alkyl benzene sulfonate, alkyl sulfate, ether sulfate, secondary alkyl sulfate, α-olefin sulfonate, phosphate esters, sulfosuccinates, isethionates, carboxylates, or a mixture thereof.

8. The surfactant composition of claim 3 wherein said anionic surfactant acid comprises alkyl benzene sulfonic acid, acid form of phosphate ester surfactant, or a mixture thereof.

9. The surfactant composition of claim 3, wherein said nonionic surfactant comprises at least one of nonylphenol ethoxylate, alcohol ethoxylate, ethylene oxide/propylene oxide block copolymer, or a mixture thereof.

10. The surfactant composition of claim 3, wherein said ethoxylated surfactant comprises ethoxylated ether amine surfactant having the formula:

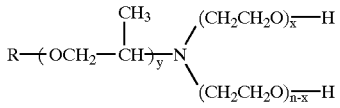

wherein: R=straight or branched alkyl group having from about 8 to about 18 carbon atoms;

n=from about 2 to about 30; and x=from about 1 to about 29 and y=1 to 30.

11. A surfactant composition formed from components comprising:

a neutralization product formed within said composition from about 8% to about 35% of the surfactant actives by weight of at least one alkylbenzene sulfonic acid surfactant and from about 8% to about 35% of the surfactant actives by weight of at least one ethoxylated surfactant, said ethoxylated surfactant being at least one ethoxylated ether amine, from about 15% to about 55% of the surfactant actives by weight of a nonionic surfactant, wherein said nonionic surfactant comprises at least one of nonylphenol ethoxylate, alcohol ethoxylate, ethylene oxide/propylene oxide block copolymer, or a mixture thereof;

from about 10% to about 90% water by weight of total weight of said composition; and from about 0% to about 9% neutralizing compound by weight of total weight of said composition, said neutralizing compound being employed in conjunction with said ethoxylated surfactant to neutralize said alkylbenzene sulfonic acid surfactant, and wherein said neutralizing compound comprises at least one of alkanolamine, alkylamine, ammonium hydroxide, sodium hydroxide, potassium hydroxide, or mixture thereof;

wherein the total active surfactant concentration is from about 10% to about 90% by weight of total weight of said composition; and wherein said ethoxylated surfactant is present in an amount less than sufficient to completely neutralize the acid functionality of an amount of said alkylbenzene sulfonic acid surfactant present; and wherein said neutralizing compound is present in an amount sufficient to partially neutralize an amount of said alkylbenzene sulfonic acid surfactant present.

12. The surfactant composition of claim 11, wherein said alkanolamine comprises at least one of monoethanolamine, diethanol amine, triethanolamine, or a mixture thereof.

13. The surfactant composition of claim 11, wherein said ethoxylated ether amine surfactant has the formula:

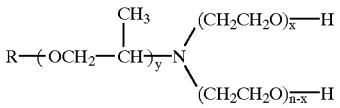

wherein: R=straight or branched alkyl group having from about 8 to about 18 carbon atoms;

n=from about 2 to about 30; and x=from about 1 to about 29 and y=1 to 30.

14. A surfactant composition formed from components comprising:

a neutralization product formed within said composition from at least one anionic surfactant acid and at least one ethoxylated ether anime surfactant;

at least one nonionic surfactant;

propylene glycol;

at least one neutralizing compound, said neutralizing, compound being employed in conjunction with said ethoxylated ether anime surfactant to neutralize said anionic surfactant acid; and substantially no water;

wherein said components are present in amounts effective, such that said surfactant solution exists as a substantially homogenous liquid phase at about 40° F.; and wherein said ethoxylated ether anime surfactant is present in an amount less than sufficient to completely neutralize an amount of said anionic surfactant acid present; and wherein said neutralizing compound is present in an amount sufficient to partially neutralize an amount of said anionic surfactant acid present.

15. The surfactant composition of claim 14, wherein said anionic surfactant acid comprises the acid form of at least one of alkyl benzene sulfonate, alkyl sulfate, ether sulfate, secondary, alkyl sulfate, α-olefin sulfonate, phosphate esters, sulfosuccinates, isethionates, carboxylates, or a mixture thereof.

16. The surfactant composition of claim 14, wherein said anionic surfactant acid comprises at least one of sulfonated anionic surfactant acid, acid form of phosphate ester, or a mixture thereof.

17. The surfactant composition of claim 14, wherein said anionic surfactant acid comprises alkyl benzene sulfonic acid.

18. The surfactant composition of claim 14, wherein said ether amine surfactant comprises at least one of:

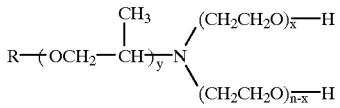

wherein: R=straight or branched alkyl group having from about 8 to about 18 carbon atoms;

n=from about 2 to about 30; and x=from about 1 to about 29 and y=1 to 30; or a mixture thereof.

* * * * *

UNITED STATES PATENT AND TRADEMARK OFFICE

CERTIFICATE OF CORRECTION

PATENT NO. : 6,617,303 B1 
DATED : September 9, 2003
INVENTOR(S) : George A. Smith and Raeda M. Smadi It is certified that error appears in the above-identified patent and that said Letters Patent is hereby corrected as shown below:

Column 22,
Line 63, after "secondary", please delete ",".

Column 23,
Line 7, before "ether", please insert -- ethoxylated --.

Signed and Sealed this

Sixteenth Day of December, 2003

JAMES E. ROGAN
*Director of the United States Patent and Trademark Office*